US010208917B2

(12) United States Patent
Yi et al.

(10) Patent No.: US 10,208,917 B2
(45) Date of Patent: Feb. 19, 2019

(54) LAMP

(71) Applicant: GE LIGHTING SOLUTIONS, LLC, East Cleveland, OH (US)

(72) Inventors: Qing Yi, Shanghai (CN); Zhiyong Wang, Shanghai (CN); Jinlin Cao, Xi'an (CN); Dazhen Wang, Xi'an (CN); Yang Shen, Shanghai (CN)

(73) Assignee: GE Lighting Solutions, LLC, East Cleveland, OH (US)

( * ) Notice: Subject to any disclaimer, the term of this patent is extended or adjusted under 35 U.S.C. 154(b) by 0 days.

(21) Appl. No.: 15/486,339

(22) Filed: Apr. 13, 2017

(65) Prior Publication Data

US 2017/0336047 A1 Nov. 23, 2017

(30) Foreign Application Priority Data

Apr. 19, 2016 (CN) ..... 2016 1 0242851

(51) Int. Cl.
*F21V 3/02* (2006.01)
*F21V 19/00* (2006.01)
(Continued)

(52) U.S. Cl.
CPC ..... *F21V 3/02* (2013.01); *F21K 9/272* (2016.08); *F21K 9/278* (2016.08); *F21V 17/12* (2013.01);
(Continued)

(58) Field of Classification Search
CPC ..... F21K 9/237; F21K 9/272; F21K 9/275; F21K 9/278; F21K 9/62; F21S 4/20; F21V 7/005; F21V 19/003; F21V 19/0055; F21V 23/00; F21V 23/004; F21V 23/005; F21V 3/02; F21V 3/061; F21V 3/0615;
(Continued)

(56) References Cited

U.S. PATENT DOCUMENTS 7,997,770 B1 * 8/2011 Meurer ..... F21K 9/272 362/171
8,092,043 B2 * 1/2012 Lin ..... H05K 1/141 362/221
(Continued)

FOREIGN PATENT DOCUMENTS

CN 202532263 U 11/2012
CN 202992797 U 6/2013
(Continued)

*Primary Examiner* — Hargobind S Sawhney
(74) *Attorney, Agent, or Firm* — Peter T. DiMauro; GPO Global Patent Operation

(57) ABSTRACT

A lamp is disclosed, which comprises a tubular, an elongate and two end-caps, wherein the tubular body comprises two ends of the tubular body; the elongate light source board is inside the tubular body along a longitudinal direction thereof, and the elongate light source board comprises at least one light source arranged thereon and two ends of the elongate light source board; two end-caps are adapted to seal the two ends of the tubular body respectively, and at least one end-cap is slidingly connected to one of the two ends of the tubular body and fixedly connected to one of the two ends of the elongate light source board. The lamp of the present disclosure can be adapted to temperature changes, and can avoid an overall length variation, and/or a bending deformation in appearance.

10 Claims, 6 Drawing Sheets

(51) Int. Cl.

| | |
|---|---|
| ***F21K 9/272*** | (2016.01) |
| ***F21K 9/278*** | (2016.01) |
| ***F21V 17/12*** | (2006.01) |
| *F21Y 103/10* | (2016.01) |
| *F21Y 115/10* | (2016.01) |

(52) U.S. Cl.
CPC ..... *F21V 19/0055* (2013.01); *F21Y 2103/10* (2016.08); *F21Y 2115/10* (2016.08)

(58) Field of Classification Search
CPC ..... F21Y 2103/10; F21Y 2115/10; F21Y 2105/10; F21Y 2107/90
See application file for complete search history.

(56) References Cited

U.S. PATENT DOCUMENTS 8,272,764 B2 * 9/2012 Son ..... F21V 3/02 315/152
8,444,292 B2 * 5/2013 Ivey ..... B29C 39/10 156/60
8,449,139 B1 * 5/2013 Wang ..... A01K 63/06 362/218
8,674,622 B2 * 3/2014 Vigilante ..... H05B 33/0809 315/247
2010/0277918 A1 * 11/2010 Chen ..... F21V 23/00 362/249.02
2011/0141723 A1 * 6/2011 Lai ..... F21V 19/0045 362/218
2015/0260379 A1 * 9/2015 Li ..... F21V 19/0055 362/217.13
2015/0345712 A1 * 12/2015 Purdy ..... F21K 9/175 362/223
2016/0178137 A1 * 6/2016 Jiang ..... F21V 3/061 362/222

FOREIGN PATENT DOCUMENTS

CN 203586001 U * 5/2014
CN 204268159 U 4/2015
CN 204829391 U 12/2015

* cited by examiner

LAMP

TECHNOLOGY FIELD

The present disclosure relates to lighting technology, and more particularly to a lamp which is adapted to temperature changes, and can avoid an overall length variation, and/or a bending deformation in appearance.

BACKGROUND

In recent years, more and more fluorescent lamps in lighting industry have been replaced by LED lamps using light-emitting diodes (LED) as light sources. The LED lamps are more efficient, energy-saving, and environmental-friendly. And the LED lamps have longer service life.

Linear LED lamps are also known as LED tubes. Currently, LED tubes in the market usually use tubular plastic light covers, for example, the plastic light covers may be made from polycarbonate (PC) material. The tubular light cover has two ends fixedly connected to two end-caps, and an LED light source board and a driving unit are installed inside the tubular light cover. As the LED tubes are used in different occasions and regions, even in the same area, the temperature changes will happen at different times, the tubular plastic light cover may have length variation due to thermal expansion and contraction in the case of temperature changes. For an LED tube, which has not been installed, if the LED tube becomes longer or shorter, it cannot be installed. For an LED tube, which has been installed in a lamp holder, if the LED tube becomes longer or shorter, the tubular plastic light cover will be bent and deformed in appearance, even the tubular plastic light cover will be disconnected with the end-cap, so that the LED tube will be damaged and there will be a danger of electric leakage.

BRIEF DESCRIPTION

To solve the above-mentioned problems, the present invention discloses a lamp which is adapted to temperature changes. The overall length variation of the lamp, and/or the bending deformation in appearance can be avoided.

The present invention discloses a lamp comprising: a tubular body having two ends of the tubular body; an elongate light source board inside the tubular body along a longitudinal direction thereof, the elongate light source board having at least one light source arranged thereon and two ends of the elongate light source board; and two end-caps are adapted to seal the two ends of the tubular body respectively, at least one end-cap being slidingly connected to one of the two ends of the tubular body and fixedly connected to one of the two ends of the elongate light source board.

In some embodiments, the at least one end-cap comprises a cavity for receiving the one of the two ends of the tubular body and being adapted to the length variation of the tubular body due to thermal expansion and contraction of the tubular body.

In some embodiments, the at least one end-cap comprises a through hole, and the one of the two ends of the elongate light source board comprises a screw hole adapted to match with the through hole. The at least one end-cap is fixedly connected to the one of the two ends of the elongate light source board through a screw.

In some embodiments, the length of the elongate light source board is longer than the length of the tubular body, and at least one end of the elongate light source board extends outside of the tubular body.

In some embodiments, the cross-section of the tubular body has a first width and a second width. The first width is the largest width parallel to the cross-section of the elongate light source board, and the second width is the largest width perpendicular to the cross-section of the elongate light source board. The first width is smaller than the second width.

In some embodiments, the cross-section of the tubular body is oval-shaped, rectangular or water-droplet-shaped.

In some embodiments, the tubular body further comprises at least one pair of fixing grooves formed on both sides of the inner surface of the tubular body for securing the elongate light source board.

In some embodiments, the tubular body comprises a light transmitting part and a light reflective part separated by a plane of the elongate light source board. The light transmitting part is toward the light-emitting direction of the at least one light source, and the light reflective part is back to the light-emitting direction of the at least one light source.

Preferably, the light transmitting part is bigger than the light reflective part.

In some embodiments, the tubular body is formed integrally.

The lamp of the present disclosure is structurally designed, so that at least one of the two end-caps is slidingly connected to one of the two ends of the tubular body and fixedly connected to one of the two ends of the elongate light source board, therefore, two ends of the tubular body are not completely fixed, and the overall length of the lamp is determined by the length of the elongate light source board, not by the length of the tubular body. When the environmental temperature changes cause the length variation due to the thermal expansion and contraction of the tubular body, the tubular body is relatively sliding with the end-cap by using the cavity of the end-cap. Furthermore, the thermal expansion and contraction of the elongate light source board is small, so the overall length variation of the lamp, and/or the bending deformation in appearance can be avoided.

DRAWINGS

DETAILED DESCRIPTION

The present invention is described in detail as following with reference to the accompanying drawings and embodiments.

Figure 1:
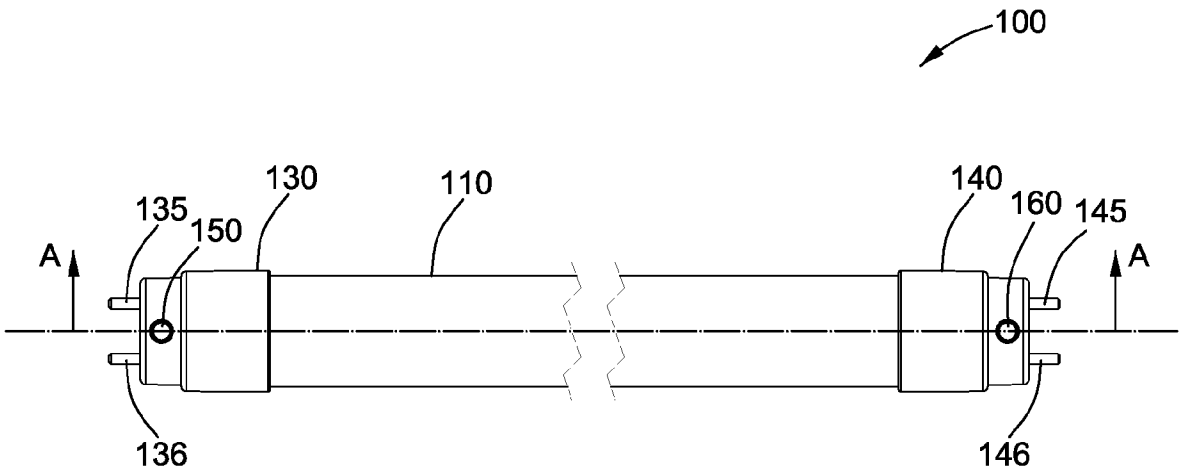
FIG. 1 is a top view of a first embodiment of the present invention.
Figure 2:
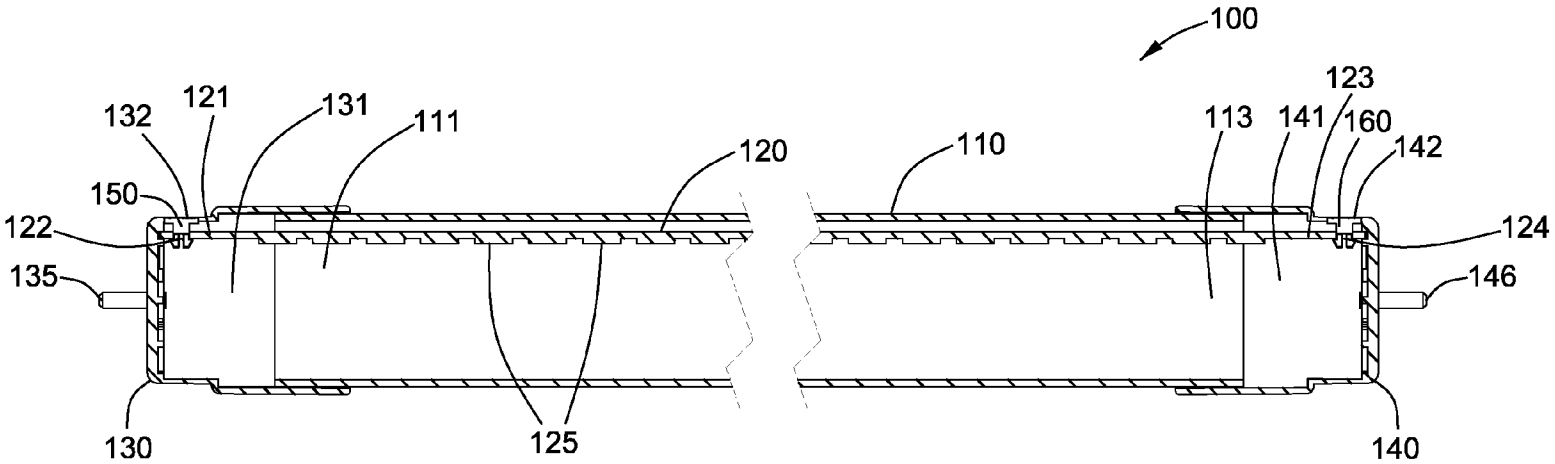
FIG. 2 is a section view of FIG. 1 in the direction of AA.
Figure 3:
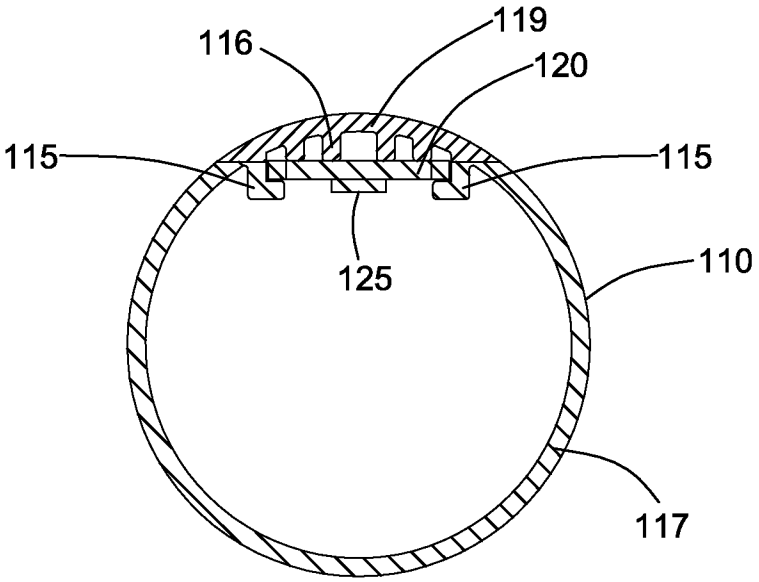
FIG. 3 is a cross-sectional view of the first embodiment of the present invention.

FIG. 1 to FIG. 3 illustrate a lamp 100 of the first embodiment of the present invention, which comprises a tubular body 110, an elongate light source board 120 and two end-caps 130, 140. The tubular body 110 comprises a plastic light cover and two ends 111, 113. As shown in FIG. 3, a cross-section of the tubular body 110 is circular. On an inner surface of the tubular body 110, a fixing groove 115 and a reinforcing rib 116 are set along a longitudinal direction of the tubular body 110 for securing the elongate light source board 120 and increasing the bending strength of the tubular body 110. The tubular body 110, the fixing groove 115 and the reinforcing rib 116 on the inner surface thereof are formed integrally. For example, they are formed integrally by injection molding method.

As shown in FIG. 2, the elongate light source board 120 is a strip inside the tubular body 110 along a longitudinal direction thereof and comprises two ends 121, 123 and two screw holes 122, 124 located at the two ends 121, 123 respectively, and a plurality of LED light sources 125 located on the same side of the elongate light source board 120. The length of the elongate light source board 120 is longer than the length of the tubular body 110, therefore, two ends 121, 123 extend outside of the tubular body 110. The two end-caps 130, 140 are adapted to seal the two ends 111, 113 of the tubular body 110. The end-cap 130 includes a cylinder cavity 131, a through hole 132 perpendicular to the longitudinal direction of the cylinder cavity 131, and two pins 135,136 extending outwardly. Wherein the cylinder cavity 131 is used for receiving the end 111 of the tubular body 110. The cylinder cavity 131 and the end 111 contact closely and may relatively slide along the longitudinal direction of the cylinder cavity 131 or the longitudinal direction of the tubular body 110. The through hole 132 in the end-cap 130 is matched with the screw hole 122 on the elongate light source board, and the end-cap 130 is fixedly connection to the end 121 of the elongate light source board 120 through a screw 150. The end-cap 140 has a symmetrical structure with the end-cap 130, and the end-cap 140 also includes a cylinder cavity 141, a through hole 142 and two pins 145, 146 extending outwardly. The end-cap 140 is slidingly connected to the end 113 of the tubular body 110, and is fixedly connected to the end 123 of the elongate light source board 120.

Furthermore, the lamp 100 of the first embodiment of the present invention is a dual-colored lamp. As shown in FIG. 3, the tubular body 110 includes a light transmitting part 117 and a light reflective part 119. The boundary of the light transmitting part 117 and the light reflective part 119 is on the plane of the elongate light source board 120. The light transmitting part 117 towards the luminous side of the LED light source 125 and allows light emitting. The light reflective part 119 is on the back-side of LED light source 125 and the light could not be emitted. Therefore, it will effectively prevent the formation of the dark areas and make the light of the lamp 100 more beautiful. In the present embodiment, the area of the light transmitting part 117 is about three to four times than the area of the light reflective part 119, however, the persons skilled in the art may divide the areas of the light transmitting part 117 and the light reflective part 119 reasonably according to actual needs.

Structurally, two end-caps 130, 140 of the lamp 100 of the first embodiment of the present invention are fixedly connected to two ends of the elongate light source board 120 respectively. Therefore, the overall length of the lamp 100 is determined by the length of the elongate light source board 120, not by the length of the tubular body 110. The tubular body 110, i.e. plastic light cover, has two ends 111, 113 received in the cylinder cavities 131, 141 of the two end-caps 130, 140. The design standards of the length of the tubular body 110 and the length of the cylinder cavities 131, 141 are: in a certain temperature change range, the two ends of the tubular body 110 are always sealed by the two end-caps 130,140. At the lowest temperature, either end of the tubular body 110 does not drop off the cylinder cavities 131, 141. At the highest temperature, the cylinder cavities 131, 141 still can accommodate the tubular body 110 which may become longer due to the thermal expansion.

The thermal expansion and contraction of the tubular body 110 generated by the temperature changes is obvious, because the tubular body 110 is made from plastic material. The structure design of the lamp 100 of the first embodiment of the present invention has resolved the length variation problem caused by the thermal expansion and contraction of the tubular body 110. Although the elongate light source board and the end-cap also have the problem of the thermal expansion and contraction, the size variation is quite small determined by their material used. Since the effect on overall size of the lamp 100 is quite small, it will not be discussed here.

Figure 4:
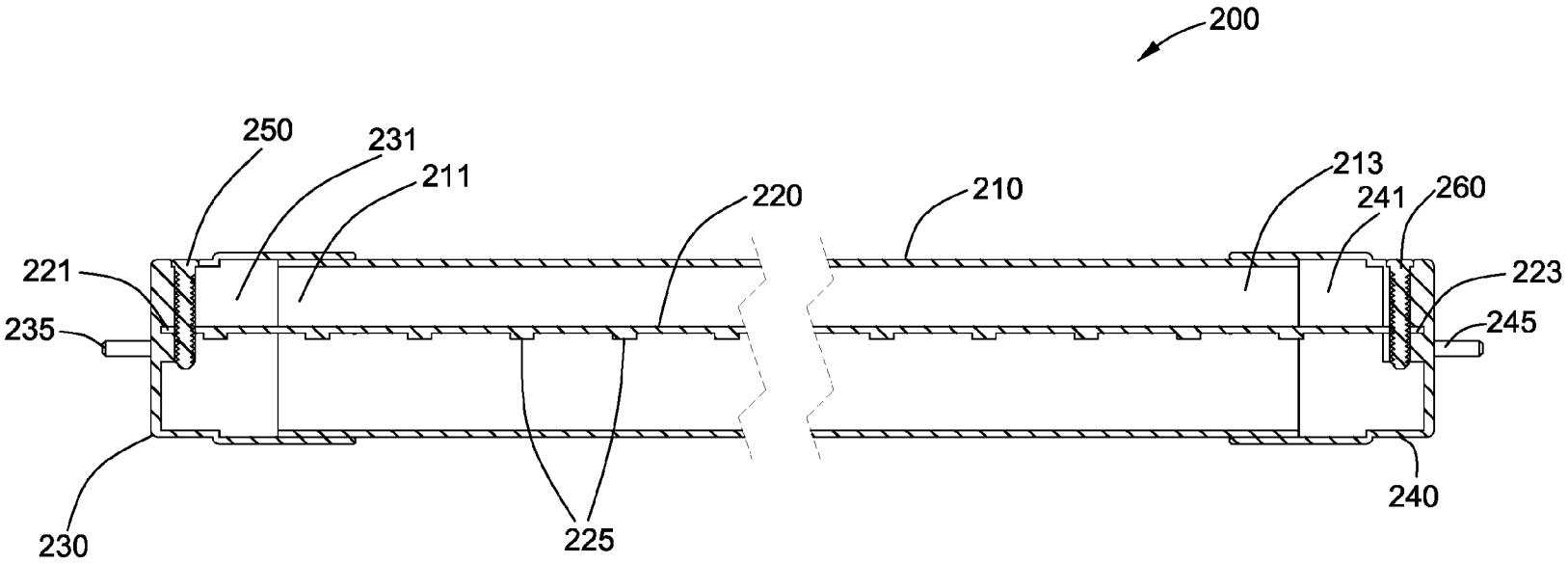
FIG. 4 is a section view of a second embodiment of the present invention.
Figure 5:
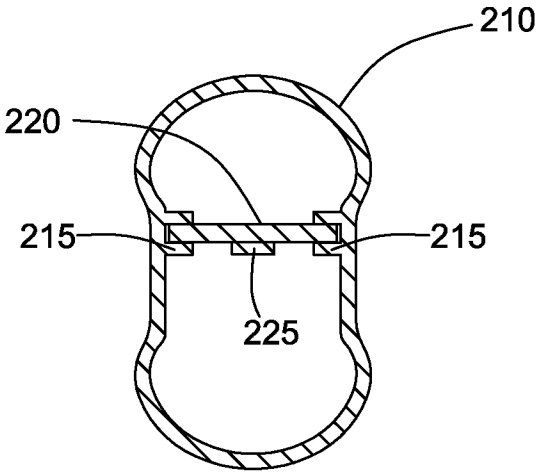
FIG. 5 is a cross-sectional view of the second embodiment of the present invention.

FIG. 4 illustrates a section view of a lamp 200 of the second embodiment of the present invention. The structure of the lamp 200 is similar to the structure of the lamp 100 of the first embodiment. The mainly difference is that the tubular body 210 of the lamp 200 has an oval-shaped cross-section, as shown in FIG. 5. On the inner surface of the tubular body 210, a fixing groove 215 is set along a longitudinal direction of the tubular body 210 for securing an elongate light source board 220. The tubular body 210 and the fixing groove 215 on the inner surface thereof are formed integrally, for example, they are formed integrally by injection molding method. Compared with the tubular body 110 which has a circular cross-section, the advantages of oval-shaped cross-section include: firstly, it can save materials: for the lamps of the same size, about 11% materials can be saved producing the tubular body 210 with the oval-shaped cross-section comparing with producing the tubular body 110 with the circular cross-section. Furthermore, the tubular body 210 with oval-shaped cross-section can install a more narrow light source board, so the materials of the light source board can be saved. Secondly, the bending resistance is better. Proved by mechanical strength simulation, the bending resistance of the tubular body with the oval-shaped cross-section is better than the tubular body with the circular cross-section when the long axis of the oval-shaped cross-section in a vertical direction. Thirdly, the tubular body with the oval-shaped cross-section can improve the light angle of the light source to achieve a wider light distribution.

Figure 6:
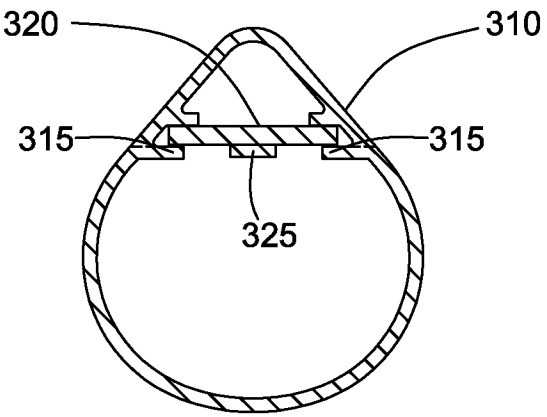
FIG. 6 is a cross-sectional view of a third embodiment of the present invention.

FIG. 6 illustrates a cross-sectional view of a lamp 300 of the third embodiment of the present invention. The structure of the lamp 300 is similar to the structure of the lamp 100 of the first embodiment. The mainly difference is that the tubular body 310 of the lamp 300 has a water-droplet-shaped cross-section, as shown in FIG. 6. About the water-droplet-shaped cross-section of the tubular body 310, specifically, separated by a plane of the elongate light source board 320, the upper part of the cross-section of the tubular body 310 is triangular, and the lower part of the cross-section is circular. On an inner surface of the tubular body 310, a fixing groove 315 is set along a longitudinal direction of the tubular body 310 for securing the elongate light source board 320. The tubular body 310 and the fixing groove 315 on the inner surface thereof are formed integrally, for example, they are formed integrally by injection molding method. Compared with the tubular body 110 with a circular cross-section, the tubular body 310 with a water-droplet-shaped cross-section is similar to the tubular body 210 with an oval-shaped cross-section and has the advantages of saving materials, better bending resistance and bigger light angle.

While the invention has been illustrated, and described in typical embodiments, it is not intended to be limited to the details shown, since various modifications and substitutions can be made without departing in any way from the spirit of the present invention. As such, further modifications and equivalents of the invention herein disclosed may occur to persons skilled in the art using no more than routine experimentation, and all such modifications and equivalents are believed to be within the spirit and scope of the invention as defined by the following claims.

What is claimed:

1. A lamp, comprising:

a tubular body having two ends of the tubular body;

an elongate light source board inside the tubular body along a longitudinal direction thereof, the elongate light source board having at least one light source arranged thereon and two ends of the elongate light source board; and two end-caps adapted to seal the two ends of the tubular body respectively, at least one end-cap being slidingly connected to one of the two ends of the tubular body and fixedly connected to one of the two ends of the elongate light source board;

wherein the at least one end-cap comprises a through hole, the one of the two ends of the elongate light source board comprises a screw hole adapted to match with the through hole, the at least one end-cap fixedly connected to the one of the two ends of the elongate light source board through a screw.

2. The lamp according to claim 1, wherein the at least one end-cap comprises a cavity for receiving the one of the two ends of the tubular body and being adapted to the length variation of the tubular body due to thermal expansion and contraction of the tubular body.

3. The lamp according to claim 1, wherein the length of the elongate light source board is longer than the length of the tubular body, at least one end of the elongate light source board extends outside of the tubular body.

4. The lamp according to claim 1, wherein a cross-section of the tubular body is oval-shaped, rectangular or water-droplet-shaped.

5. The lamp according to claim 1, wherein the tubular body further comprises at least one pair of fixing grooves formed on both sides of the inner surface of the tubular body for securing the elongate light source board.

6. The lamp according to claim 1, wherein the tubular body comprises a light transmitting part and a light reflective part separated by a plane of the elongate light source board, the light transmitting part is toward the light-emitting direction of the at least one light source, the light reflective part is back to the light-emitting direction of the at least one light source.

7. The lamp according to claim 6, wherein the light transmitting part is bigger than the light reflective part.

8. The lamp according to any one of claim 1, claim 5 to claim 7, wherein the tubular body is formed integrally.

9. A lamp, comprising:

a tubular body having two ends of the tubular body;

an elongate light source board inside the tubular body along a longitudinal direction thereof, the elongate light source board having at least one light source arranged thereon and two ends of the elongate light source board; and two end-caps adapted to seal the two ends of the tubular body respectively, at least one end-cap being slidingly connected to one of the two ends of the tubular body and fixedly connected to one of the two ends of the elongate light source board;

wherein the tubular body comprises a light transmitting part and a light reflective part separated by a plane of the elongate light source board, the light transmitting part is toward the light-emitting direction of the at least one light source, the light reflective part is back to the light-emitting direction of the at least one light source.

10. The lamp according to claim 9, wherein the light transmitting part is bigger than the light reflective part.

* * * * *